US009436114B2

(12) United States Patent
Kawahara et al.

(10) Patent No.: US 9,436,114 B2
(45) Date of Patent: Sep. 6, 2016

(54) IMAGE FORMING APPARATUS AND IMAGE FORMING UNIT

(71) Applicant: FUJI XEROX CO., LTD., Tokyo (JP)

(72) Inventors: Ichiro Kawahara, Kanagawa (JP); Hiroki Ando, Kanagawa (JP); Mikio Yamaguchi, Kanagawa (JP); Hirofumi Iida, Kanagawa (JP); Keishi Araki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/603,004

(22) Filed: Jan. 22, 2015

(65) Prior Publication Data

US 2016/0041489 A1 Feb. 11, 2016

(30) Foreign Application Priority Data

Aug. 8, 2014 (JP) ..... 2014-162401

(51) Int. Cl.
*G03G 15/02* (2006.01)

(52) U.S. Cl.
CPC ..... *G03G 15/02* (2013.01)

(58) Field of Classification Search
CPC ..... G03G 15/02; G03G 15/0233; G03G 15/0275
See application file for complete search history.

(56) References Cited

U.S. PATENT DOCUMENTS

| | | | | |
|---|---|---|---|---|
| 4,972,771 | A * | 11/1990 | Weisgerber et al. | 101/148 |
| 5,534,344 | A * | 7/1996 | Kisu et al. | 428/323 |
| 6,546,860 | B1 * | 4/2003 | Heiler | 101/147 |
| 2004/0074357 | A1 * | 4/2004 | Teshima | 83/169 |
| 2006/0257772 | A1 * | 11/2006 | Takiguchi et al. | 430/108.6 |
| 2010/0074652 | A1 * | 3/2010 | Aoshima | G03G 15/0233 399/174 |

FOREIGN PATENT DOCUMENTS

| | | | |
|---|---|---|---|
| JP | H04-145462 | A | 5/1992 |
| JP | H05-273844 | A | 10/1993 |
| JP | 2002-014521 | A | 1/2002 |

* cited by examiner

*Primary Examiner* — David Gray
*Assistant Examiner* — Sevan A Aydin
(74) *Attorney, Agent, or Firm* — Oliff PLC

(57) ABSTRACT

Provided is an image forming apparatus including an image holder that is provided to be rotatable, and a charging member that includes a charging member main body and a cover member, in which an outer circumferential surface of the cover member is disposed to be in contact with the image holder, and that charges the image holder, wherein a circumferential speed of one member of the rotating image holder and the rotating charging member main body is greater than a circumferential speed of the other member, and wherein the cover member moves to follow a movement of the one member at a contact portion where the cover member and the image holder come into contact with each other, and a portion of the cover member that is positioned on an upstream side of the contact portion is drawn toward a downstream side.

19 Claims, 7 Drawing Sheets

END IN AXIAL DIRECTION

CENTER IN AXIAL DIRECTION

IMAGE FORMING APPARATUS AND IMAGE FORMING UNIT

CROSS-REFERENCE TO RELATED APPLICATIONS

This application is based on and claims priority under 35 USC 119 from Japanese Patent Application No. 2014-162401 filed Aug. 8, 2014.

BACKGROUND

Technical Field

The present invention relates to an image forming apparatus and an image forming unit.

SUMMARY

According to an aspect of the invention, there is provided an image forming apparatus including:

an image holder that is provided to be rotatable; and a charging member that includes a charging member main body that has an outer circumferential surface and that is provided to be rotatable and a cover member that covers an outer circumferential surface of the charging member main body which is a separate member from the charging member main body, in which an outer circumferential surface of the cover member is disposed to be in contact with the image holder, and that charges the image holder, wherein a circumferential speed of one member of the rotating image holder and the rotating charging member main body is greater than a circumferential speed of the other member, and wherein the cover member moves to follow a movement of the one member at a contact portion where the cover member and the image holder come into contact with each other, and a portion of the cover member that is positioned on an upstream side of the contact portion is drawn toward a downstream side.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described with reference to the accompanying drawings.

Figure 1:
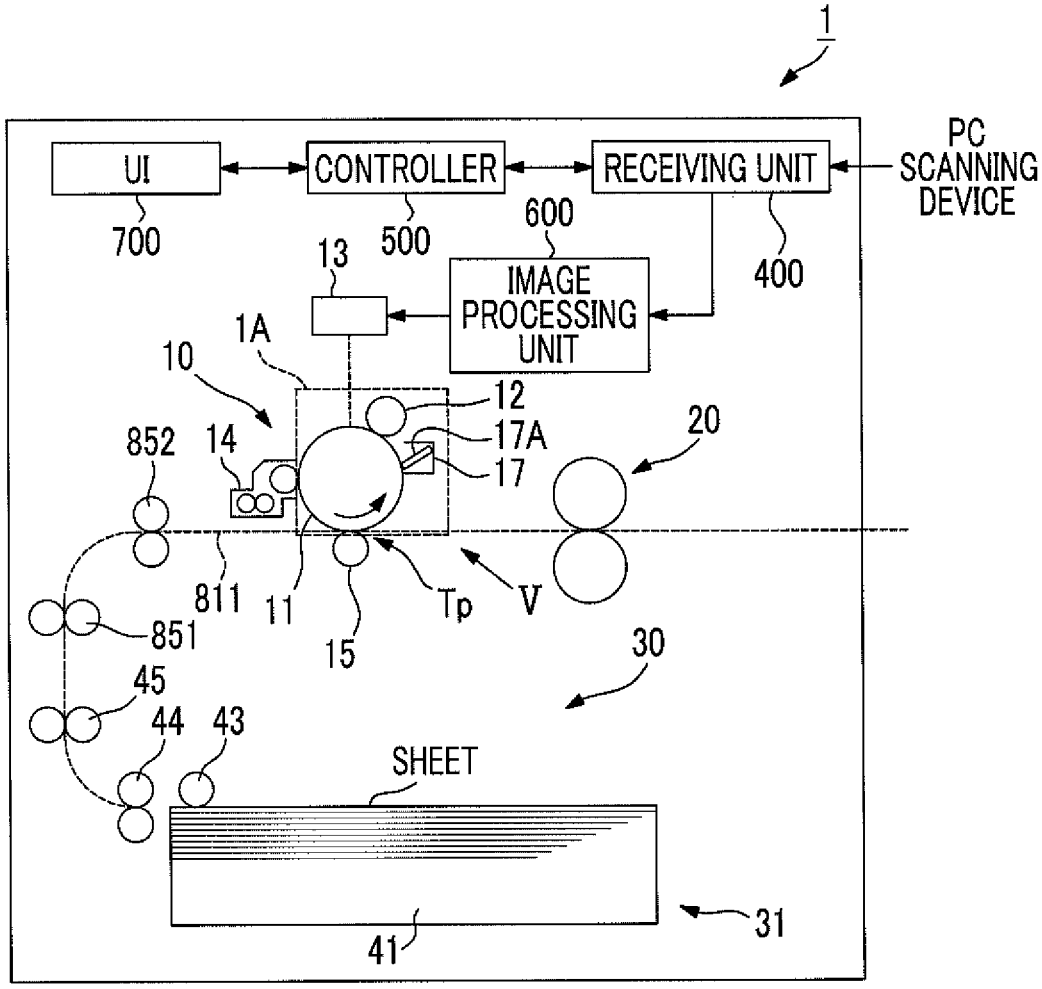
FIG. 1 is a view schematically illustrating a configuration of an image forming apparatus to which an exemplary embodiment is applied.

FIG. 1 is a view schematically illustrating a configuration of an image forming apparatus 1 to which the exemplary embodiment is applied. The image forming apparatus 1 is provided with an image forming unit 10 that forms a toner image on a sheet as an example of a recording medium, a fixing unit 20 that heats and presses to fix the toner image formed on the sheet by the image forming unit 10, and a sheet supplying unit 30 that supplies a sheet to the image forming unit 10.

The image forming unit 10 is provided with a photosensitive drum 11 as an example of the image holder. Further, in the image forming unit 10, a charging member 12, an exposure device 13, a developing device 14, a transfer device 15, and a cleaning device 17 are provided.

The photosensitive drum 11 includes a photosensitive layer on the outer circumferential surface and performs rotational driving in an arrow direction (counterclockwise direction) in FIG. 1.

The charging member 12 is configured of a charging roll that is in contact with the photosensitive drum 11 and charges the rotating photosensitive drum 11 to a predetermined potential.

The exposure device 13 selectively exposes portions of the photosensitive drum 11 charged to the predetermined potential by the charging member 12 and forms an electrostatic latent image.

The developing device 14 develops the electrostatic latent image formed on the photosensitive drum 11 by using toner and forms a toner image on the photosensitive drum 11.

The transfer device 15 is formed into a roll shape and is disposed along an axial direction of the photosensitive drum 11. The transfer device 15 applies a bias voltage to the transfer unit Tp, thereby transferring the toner image on the photosensitive drum 11 (toner image held by the photosensitive drum 11) to the sheet. In addition, the transfer device 15 forms an electric field between the transfer device 15 and the photosensitive drum 11 and transfers the toner image on the photosensitive drum 11 onto the sheet.

The cleaning device 17 includes a cleaning blade 17A disposed to be in contact with the photosensitive drum 11 and removes toner or the like remaining on the photosensitive drum 11.

A sheet storage section 41, a pull-in roll 43, and a pick-out mechanism 44 are provided in the sheet supplying unit 30. The sheet storage section 41 is a rectangular parallelepiped, of which the top side is opened and sheets are stored inside. The pull-in roll 43 comes into contact with the uppermost sheet from a bundle of sheets stored in the sheet storage section 41 and delivers the uppermost sheet toward the pick-out mechanism 44 side. The pick-out mechanism 44 is configured to include a feed roll that is disposed, for example, to be rotatable, and a retard roll of which rotation is limited. The pick-out mechanism 44 picks out the sheets delivered from the pull-in roll 43 one by one. Then, the picked sheet is delivered toward a transport roll 45.

The transport rolls 45 are configured to include a pair of roll-shape members. After stopping the sheet sent from the pick-out mechanism 44 for a while, the transport roll 45 transports the sheet again at a predetermined timing. A sheet path 811 is provided on the downstream side of the transport roll 45. Pre-registration rolls 851 and registration rolls 852 are attached on the sheet path 811.

The pre-registration rolls 851 transport the sheet transported by the transport rolls 45 further toward the downstream side and form a loop in cooperation with the registration rolls 852. In addition, the registration rolls 852 stop for a while and thus the transporting of the sheet is stopped temporarily, then rotate again in accordance with the timing such that a registration adjustment of the transfer unit Tp is performed and the sheet is supplied.

In addition, a receiving unit 400 that receives image data from a PC or a scanning device (not illustrated) is provided in the image forming apparatus 1. Further, a controller 500 that controls operations of the image forming unit 10, the fixing unit 20, and the sheet supplying unit 30, as a whole, is provided.

In addition, an image processing unit 600 that outputs image data to the exposure device 13 after an image process is performed to the image data received by the receiving unit 400 is provided. Further, a user interface (UI) 700 that receives an instruction from a user and displays a message or the like for the user is provided.

The controller 500 is configured to have a central processing unit (CPU), a read only memory (ROM), a random access memory (RAM), and a hard disk drive (HDD) (none illustrated). A processing program retained in the ROM or HDD is executed in the CPU. The processing programs, various tables, parameters, or the like are stored in the ROM. The RAM is used as a work area or the like during the execution of various programs by the CPU.

Figure 2:
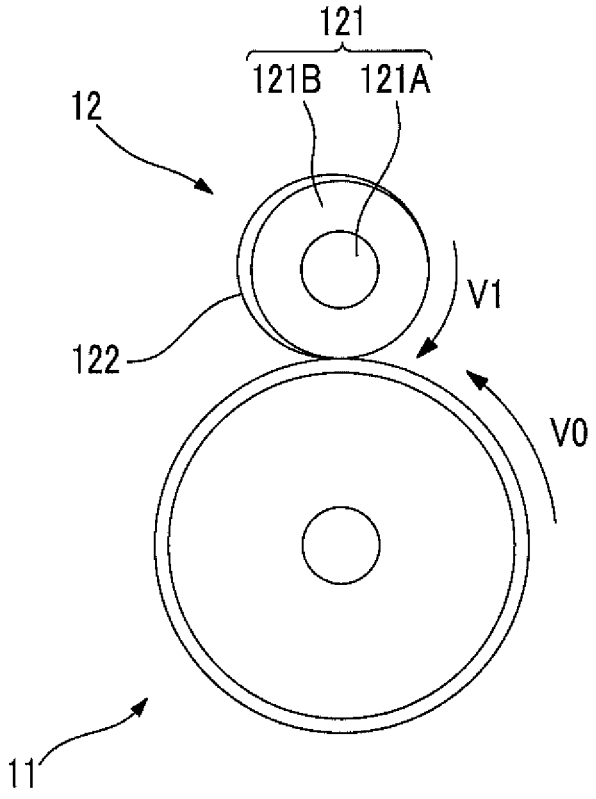
FIG. 2 is a cross-sectional view of a photosensitive drum and a charging member.

FIG. 2 is a cross-sectional view illustrating the photosensitive drum 11 and the charging member 12.

In the charging member 12 according to the exemplary embodiment, a charging member main body 121 that has an outer circumferential surface and is provided to be rotatable and a cover member 122 that is configured as a separate member from the charging member main body 121 and covers the outer circumferential surface of the charging member main body 121 are provided. According to the exemplary embodiment, the outer circumferential surface of the cover member 122 is disposed to be in contact with the photosensitive drum 11. In addition, according to the exemplary embodiment, the charging member 12 is biased toward the photosensitive drum 11 by a coil spring (to be described later), which causes the outer circumferential surface of the cover member 122 to be pressed against the photosensitive drum 11.

The charging member main body 121 is configured to have a cylindrical shaft 121A and a cylindrical elastic member 121B that is attached around the shaft 121A. The elastic member 121B is formed of a sponge (porous foamed material in which plural holes are present). To be more specific, the elastic member 121B is configured of an ethylene propylene diene monomer rubber (EPDM) sponge.

The cover member 122 is formed into a cylindrical shape (tube shape) and covers the outer circumferential surface of the elastic member 121B. Here, a material of the cover member 122 includes nylon or a polyamide. In addition, a thickness of the cover member 122 is, for example, from 0.1 mm to 0.2 mm.

Bonding of the cover member 122 to the elastic member 121B is not performed but, according to the exemplary embodiment, the cover member 122 is configured to move on the elastic member 121B.

In addition, according to the exemplary embodiment, in a natural state, the outer diameter of the elastic member 121B is less than the inner diameter of the cover member 122, which causes mounting of the cover member 122 on the elastic member 121B (insertion of the elastic member 121B into the inside of the cover member 122) to be easily performed during assembly of the charging member 12.

In addition, according to the exemplary embodiment, after the mounting of the cover member 122 on the elastic member 121B, the opposite ends of the cover member 122 are thermally contracted and the diameter is decreased, which suppresses separation of the cover member 122 from the elastic member 121B.

Further, according to the exemplary embodiment, a circumferential speed of the photosensitive drum 11 (movement speed of the outer surface of the photosensitive drum 11) is greater than the circumferential speed of the charging member main body 121 (movement speed of the outer surface of the charging member main body 121). To be more specific, as illustrated in FIG. 2, in a case where the circumferential speed of the photosensitive drum 11 is V0 and the circumferential speed of the charging member main body 121 is V1, a relationship of V0>V1 is satisfied.

According to the exemplary embodiment, the circumferential speed of the charging member main body 121 and the circumferential speed of the photosensitive drum 11 are set to satisfy a relationship of [(circumferential speed of the charging member main body 121)=(circumferential speed of the photosensitive drum 11)−((circumferential speed of the photosensitive drum 11)*(1% to 20%))]. Here, according to the findings of the present inventors, when a subtraction ratio of the circumferential speed of the photosensitive drum 11 exceeds 20%, a difference between the circumferential speed of the charging member main body 121 and the circumferential speed of the photosensitive drum 11 becomes great, and a flaw such as abrasion of the cover member 122 or the photosensitive drum 11 is likely to occur. In addition, when the subtraction ratio of the circumferential speed of the photosensitive drum 11 is less than 1%, it is difficult to suppress floppiness or slack (detailed description will be provided later) of the cover member 122.

Figure 3B:
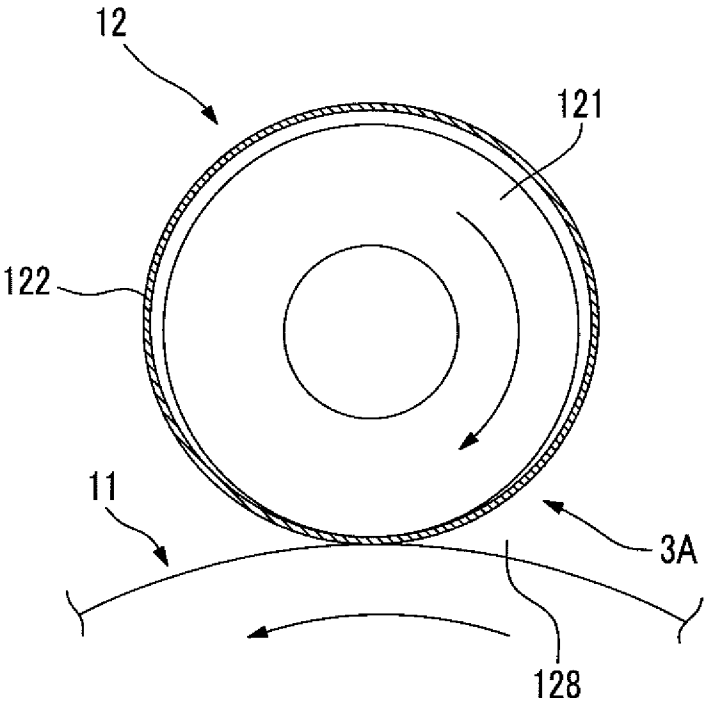
FIGS. 3A and 3B are views illustrating states of the photosensitive drum and the charging member when the photosensitive drum and the charging member rotate.
Figure 3A:
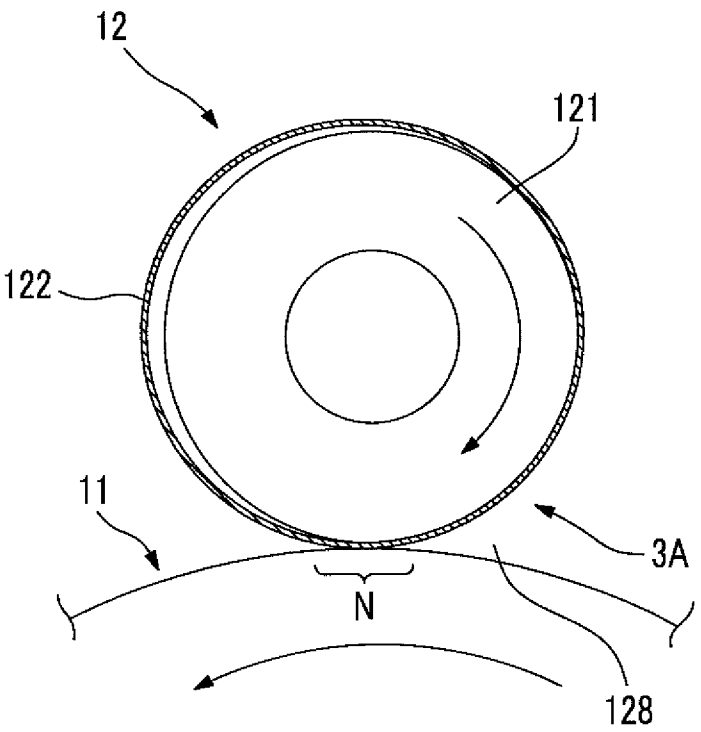
Figure 4:
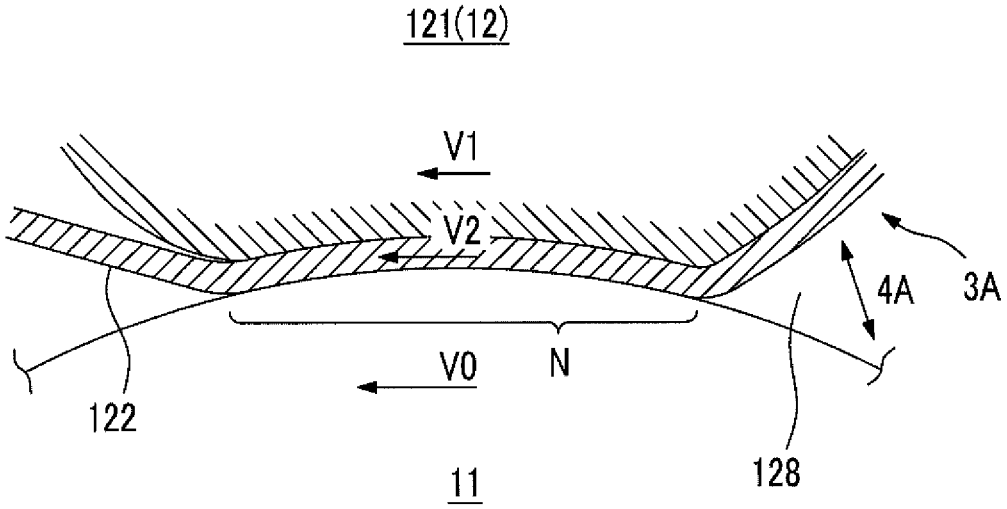
FIG. 4 is a view illustrating a state of the photosensitive drum and the charging member when the photosensitive drum and the charging member rotate.

FIGS. 3A, 3B, and 4 are views illustrating states of the photosensitive drum 11 and the charging member 12 when the photosensitive drum 11 and the charging member 12 rotate.

According to the exemplary embodiment, as described above, the circumferential speed of the photosensitive drum 11 is greater than the circumferential speed of the charging member main body 121. Further, according to the exemplary embodiment, in a nip N (see FIG. 3A) where the photosensitive drum 11 and the charging member main body 121 are pressed against each other, the cover member 122 moves by following the movement of the photosensitive drum 11. In addition, at a contact portion where the photosensitive drum 11 and the cover member 122 are in contact with each other, the cover member 122 moves by following the movement of the photosensitive drum 11.

Thus, a portion (portion represented by reference sign 3A in FIG. 3A) of the cover member 122 on the upstream side of the nip N is drawn to the downstream side. Thus, the portion represented by reference sign 3A comes into close contact with the outer circumferential surface of the photosensitive drum 11.

When description is further provided with reference to FIG. 4, when the cover member 122 enters the nip N in a state in which the circumferential speed of the photosensitive drum 11 is V0 and the circumferential speed of the charging member main body 121 is V1 (<V0), in the nip N, the cover member 122 receives a force from the photosensitive drum 11 (is pressed toward the left direction in FIG. 4 by the photosensitive drum 11) and moves at a circumferential speed V2 greater than the circumferential speed V1 of the charging member main body 121.

In this case, the portion (portion represented by reference sign 3A in FIG. 3A) (hereinafter, is referred to as "upstream side portion 3A") of the cover member 122 on the upstream side of the nip N is drawn to the downstream side and the upstream side portion 3A comes into close contact with the surface of the charging member main body 121 due to the drawing, as illustrated in FIG. 4.

Here, in the configuration according to the exemplary embodiment, as illustrated in FIG. 4, in a region on the downstream side of the nip N and a region between the outer circumferential surface of the cover member 122 and the outer circumferential surface of the photosensitive drum 11, a size (in FIG. 4, size in the vertical direction) of the height toward the downstream side in a moving direction of the cover member 122 becomes gradually smaller such that a wedge-like region 128 is formed. According to the exemplary embodiment, in the wedge-like region 128, a discharge (discharge between the charging member 12 and the photosensitive drum 11) occurs, which causes the photosensitive drum 11 to be charged.

Incidentally, when behavior of the cover member 122 becomes unstable in a case where the charging process described above is performed, a size of the wedge-like region 128 (size in the vertical direction in FIG. 4) is increased or decreased and non-uniform charging is likely to occur. According to the exemplary embodiment, as described above, the upstream side portion 3A of the cover member 122 on the upstream side of the nip N is drawn to the downstream side such that the upstream side portion 3A comes into close contact with the outer circumferential surface of the charging member main body 121. Thus, in the wedge-like region 128, the behavior of the cover member 122 becomes stable and the non-uniform charging is unlikely to occur.

Although description is not provided above, FIG. 3B illustrates a case where the circumferential speed of the photosensitive drum 11 and the circumferential speed of the charging member main body 121 are the same as each other (illustrates a comparative example). In this case, the upstream side portion 3A is not drawn to the downstream side and the upstream side portion 3A is not likely to come into close contact with the charging member main body 121. In this case, a size of the wedge-like region 128 fluctuates and the non-uniform charging is likely to occur.

When the comparative example is further described with reference to FIG. 4, in a case where the circumferential speed of the photosensitive drum 11 and the circumferential speed of the charging member main body 121 are the same as each other, close contact of the cover member 122 with the charging member main body 121 (close contact of the upstream side portion 3A into the charging member main body 121) does not occur in the upstream side of the nip N and the cover member 122 is likely to move in a direction illustrated by arrow 4A in FIG. 4. In this case, the size of the wedge-like region 128 fluctuates and the non-uniform charging is likely to occur.

According to the exemplary embodiment, both ends of the charging member 12 in the axial direction are biased toward the photosensitive drum 11 (detailed description will be provided later) and a biasing force acting on the center of the charging member 12 in the axial direction is less than when compared to both ends. Therefore, a restraining force of the cover member 122 is small at the center of the charging member 12 in the axial direction and the slack or floppiness of the cover member 122 is likely to occur at the center of the charging member 12 in the axial direction.

Figure 5:
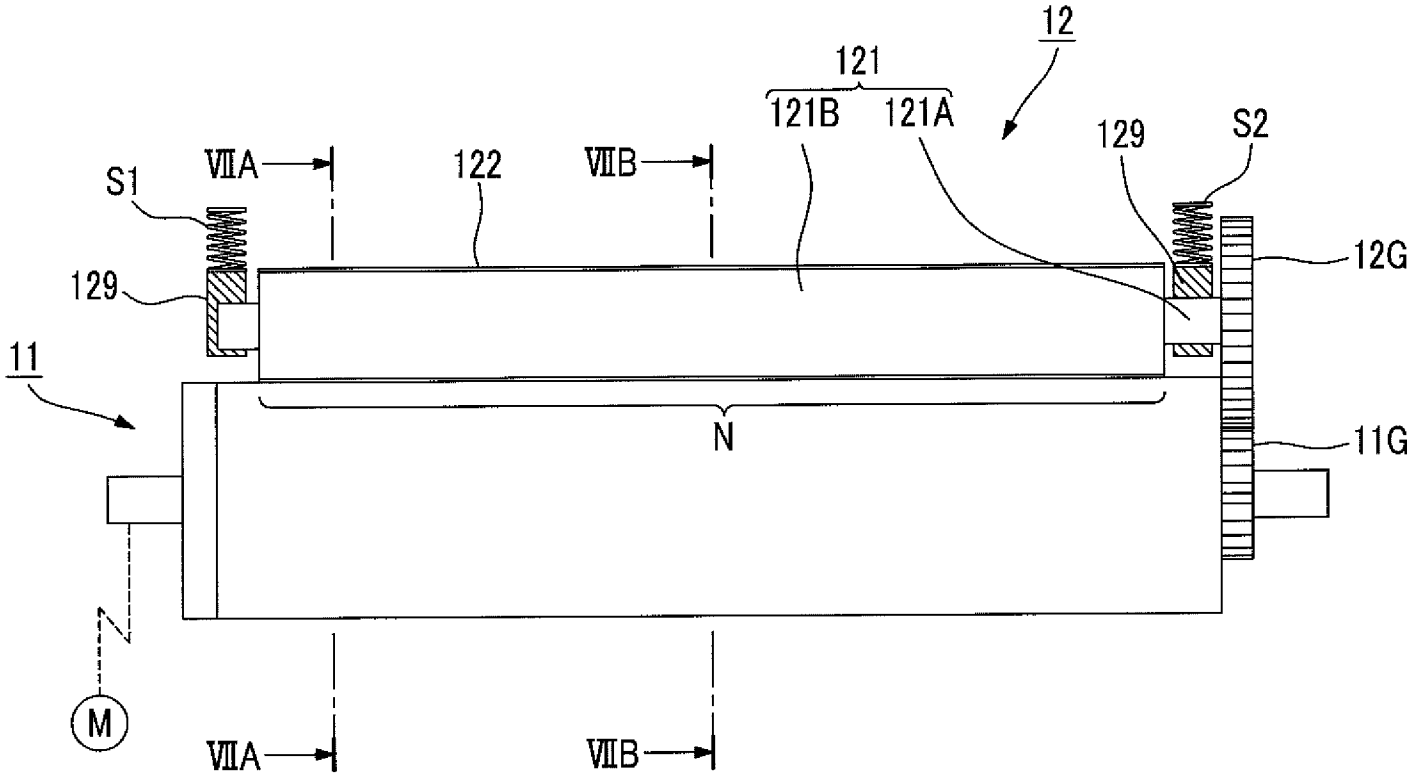
FIG. 5 is a view illustrating the photosensitive drum and the charging member when viewed from an arrow V direction in FIG. 1.

FIG. 5 is a view illustrating a case of the photosensitive drum 11 and the charging member 12 when viewed from an arrow V direction in FIG. 1.

According to the exemplary embodiment, a first spring S1 that presses one end of the shaft 121A provided in the charging member 12 toward the photosensitive drum 11 and a second spring 52 that presses the other end of the shaft 121A toward the photosensitive drum 11 are provided and thereby the charging member 12 is pressed to the photosensitive drum 11. In addition, a bearing 129 is provided between the first spring S1 and the shaft 121A and, in addition, between the second spring S2 and the shaft 121A.

Further, according to the exemplary embodiment, a rotational driving force is supplied to the photosensitive drum 11 from a motor M which is a drive source. The rotational driving force supplied to the photosensitive drum 11 is transmitted to the shaft 121A (charging member main body 121) of the charging member 12 through a drum-side gear 11G provided on the same shaft as that of the photosensitive drum 11 and a charging-side gear 12G provided on the same shaft of the charging member 12.

Here, according to the exemplary embodiment, the diameter of the drum-side gear 11G is less than the outer diameter of the photosensitive drum 11 and the diameter of the charging-side gear 12G is greater than the outer diameter of the charging member 12. Thus, according to the exemplary embodiment, the circumferential speed of the photosensitive drum 11 is different from the circumferential speed of the charging member main body 121 and the circumferential speed of the photosensitive drum 11 is higher than the circumferential speed of the charging member main body 121.

When the configuration of the exemplary embodiment is further described with reference to FIG. 5, the rotational driving force is supplied to the charging member main body 121 from either one end-side (end side on the right in FIG. 5) of one end-side or the other end-side of the charging member main body 121 in the axial direction and the rotational driving force is not supplied from the other end-side.

Thus, the slack of the cover member 122 which is likely to occur at the center of the charging member 12 in the axial direction is decreased. Here, when the gears or the like are provided on both sides of the charging member main body 121 in the axial direction and the rotational driving forces are supplied from both of the sides, portions at opposite ends (opposite ends in the axial direction) of the cover member 122 are moved before the center is moved. Therefore, the slack is likely to occur at the center of the cover member 122. When the rotational driving force is supplied from only one end-side of the charging member main body 121, the entire cover member 122 has a distorted shape and the slack is unlikely to occur at the center of the cover member 122.

Figure 6:
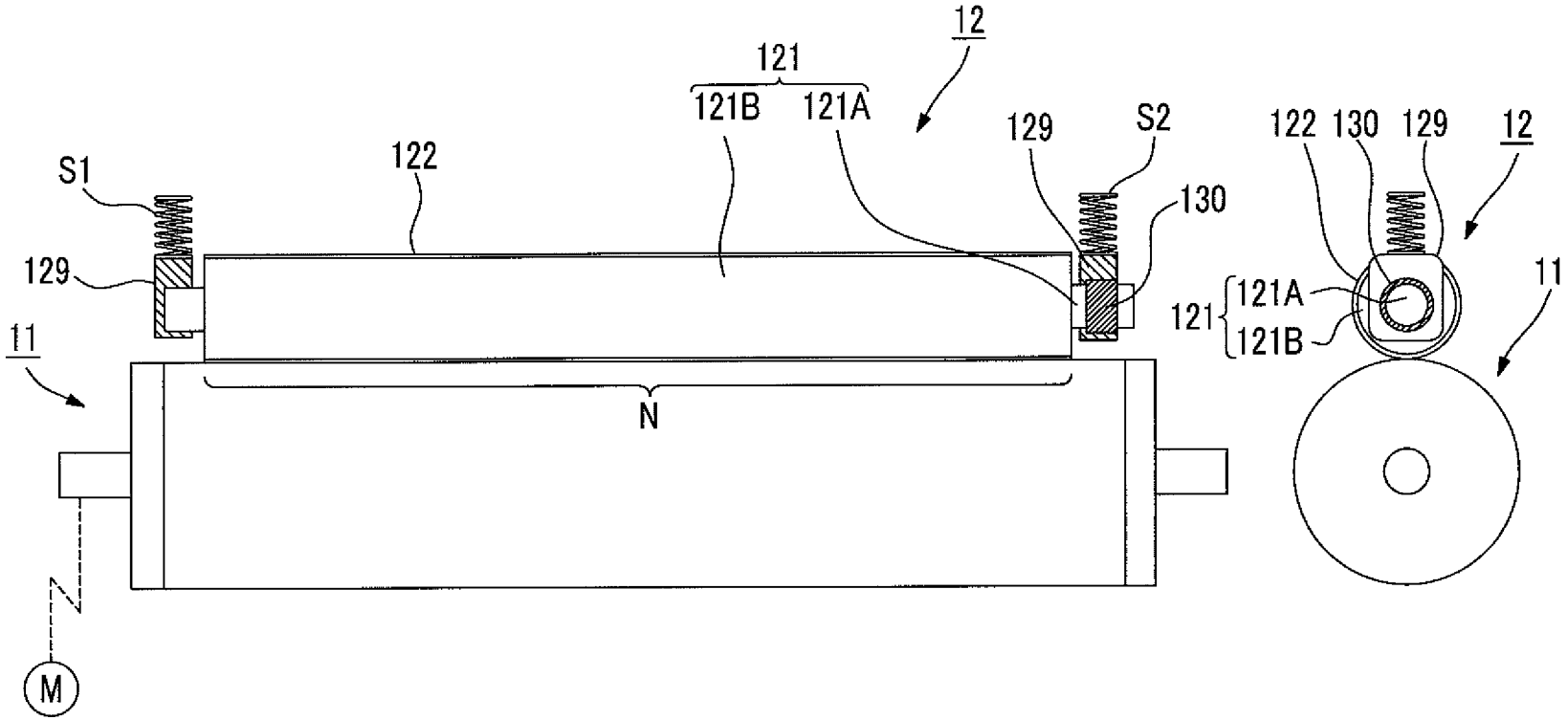
FIG. 6 is a view illustrating another example of a configuration of the photosensitive drum and the charging member.

FIG. 6 is a view illustrating another example of a configuration of the photosensitive drum 11 and the charging member 12.

In the example of the configuration illustrated in FIG. 6, a brake member 130 that is configured of an elastic body such as rubber or a sponge and is pressed against the shaft 121A is provided on one bearing 129 of two bearings 129.

Here, in the example of the configuration, the drum-side gear 11G, the charging-side gear 12G, or the like is not provided and the rotational driving force is supplied from the photosensitive drum 11 through the nip N to the charging member 12. When the rotational driving force is supplied to the charging member 12, the shaft 121A provided on the charging member 12 rotates. At this time, drag is applied to the shaft 121A from the brake member 130. Thus, the shaft 121A is unlikely to rotate and the circumferential speed of the charging member main body 121 is less than the circumferential speed of the photosensitive drum 11.

Here, in the example of the configuration illustrated in FIG. 6, the drum-side gear 11G and the charging-side gear 12G illustrated in FIG. 5 are not provided and the example of the configuration illustrated in FIG. 5 has high flexibility in layout, as compared with the configuration example illustrated in FIG. 5.

Figure 7A:
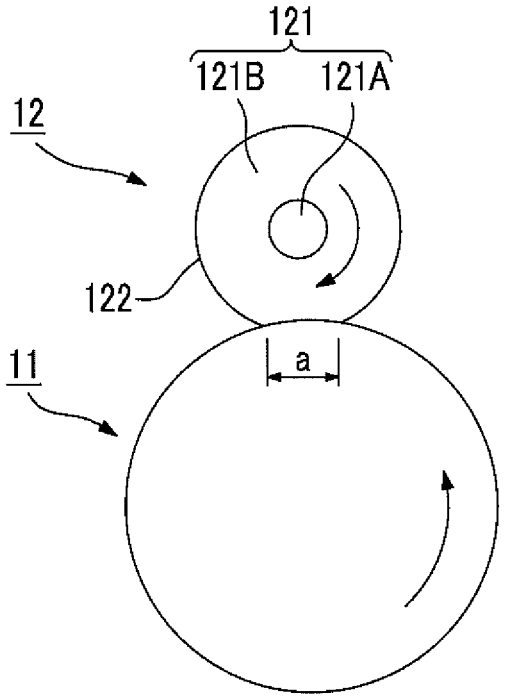
FIGS. 7A and 7B are cross-sectional views illustrating the charging member.

FIGS. 7A and 75 are cross-sectional views illustrating the charging member 12.

Figure 7B:
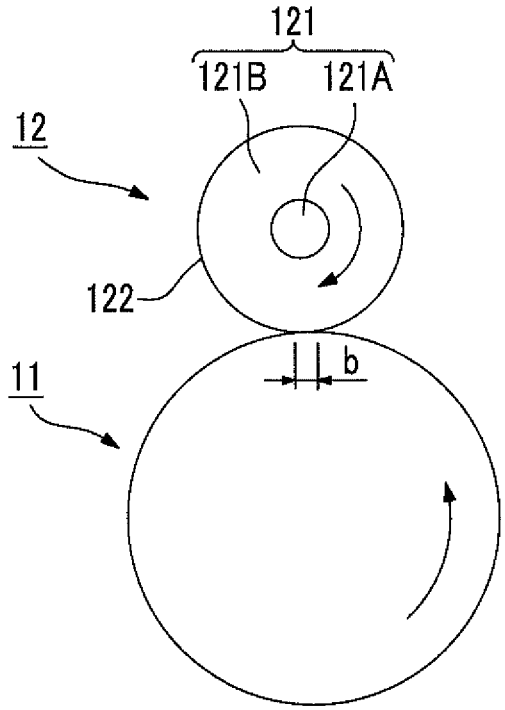

To be more exact, FIG. 7A is a cross-sectional view taken along line VIIA-VIIA in FIG. 5 and FIG. 7B is a cross-sectional view taken along line VIIB-VIIB in FIG. 5.

According to the exemplary embodiment, as illustrated in FIGS. 5 and 6, since the portions of the charging member 12 at both ends are biased toward the photosensitive drum 11, both ends of the charging member 12 are strongly pressed against the photosensitive drum 11 and a pressing force to the photosensitive drum 11 is small at the center of the charging member 12 in the axial direction.

As a result, an amount of pressed deformation of the elastic member 121B at the center in the axial direction is different from that at the ends in the axial direction. As represented by reference signs a and b in FIGS. 7A and 7B, a width of the nip becomes greater at the end of the charging member 12 and the width of the nip becomes smaller at the center of the charging member 12. In this case, the restraining force of the cover member 122 is weak at the center of the charging member 12 in the axial direction and the slack and the floppiness of the cover member 122 are likely to occur.

According to the exemplary embodiment, in order to decrease slack or the like at the center, the elastic member 121B provided on the charging member 12 is formed of a sponge.

In the case where the elastic member 121B is formed of the sponge, the elastic member 121B is more pressed and deformed also at the center in the axial direction, compared to a case where the elastic member 121B is not formed of the sponge. Thus, the width of the nip represented by reference sign b in FIG. 73 becomes greater. In this case, the restraining force of the cover member 122 is increased at the center of the charging member 12 in the axial direction and the slack or the floppiness of the cover member 122 is unlikely to occur.

Another Configuration

In the above description, the rotational driving force is supplied to the charging member 12 through the photosensitive drum 11; however, the configuration is not limited thereto. The rotational driving force may be supplied to the charging member 12 through a system different from the photosensitive drum 11.

In addition, the case in which the circumferential speed of the photosensitive drum 11 becomes higher and thereby the cover member 122 is drawn to the downstream side is described above. However, the circumferential speed of the charging member main body 121 becomes higher than the circumferential speed of the photosensitive drum 11 and thereby the cover member 122 may be drawn to the downstream side.

Although description is omitted in the example of the configuration described above, the photosensitive drum 11 and the cover member 122 are unlikely to have a slippery contact and the charging member main body 121 and the cover member 122 are likely to have a slippery contact. In the above description, the circumferential speed of the photosensitive drum 11 is great and the cover member 122 is caused to follow the speed of the photosensitive drum 11, which causes the cover member 122 to be drawn to the downstream side.

In addition, in the example of the configuration described above, in a case where the slipperiness of contact between the photosensitive drum 11 and the cover member 122 is compared to the slipperiness of contact between the charging member main body 121 and the cover member 122, the charging member main body 121 and the cover member 122 are likely to have a slippery contact and the photosensitive drum 11 and the cover member 122 are unlikely to have slippery contact. The cover member 122 is caused to follow the photosensitive drum 11 having the higher circumferential speed, which causes the cover member 122 to be drawn to the downstream side.

Incidentally, depending on a material or a surface treatment of a member, the slipperiness of contact is changed. Thus, there maybe a case where the photosensitive drum 11 and the cover member 122 are likely to have a slippery contact and the charging member main body 121 and the cover member 122 are unlikely to have slippery contact. In this case, the circumferential speed of the charging member main body 121 becomes greater than the circumferential speed of the photosensitive drum 11. In this case, the cover member 122 moves by following the charging member main body 121, which causes the cover member 122 to be drawn to the downstream side.

Another example of the configuration is further described.

According to an apparatus configuration of the image forming apparatus 1, the photosensitive drum 11 and members positioned around the photosensitive drum 11 are all unitized and form an image forming unit; however, the charging member 12 may be included in the image forming unit.

To be more specific, according to the apparatus configuration, there may be an exemplary embodiment in which a surrounding portion represented by reference sign 1A in FIG. 1 is unitized as the image forming unit and the image forming unit is attachable to and detachable from the main body side of the image forming apparatus 1. In such an exemplary embodiment, the image forming unit may include the charging member 12. Here, although there is a case where a replacement of a new image forming unit is performed due to the abrasion of the photosensitive drum 11 or the like, the charging member 12 is also replaced during the replacement.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder that is provided to be rotatable; and a charging member that includes a charging member main body that has an outer circumferential surface and that is provided to be rotatable and a cover member that covers an outer circumferential surface of the charging member main body which is a separate member from the charging member main body, in which an outer circumferential surface of the cover member is disposed to be in contact with the image holder, and that charges the image holder, wherein the image holder and the charging member main body are the only rotating devices which are used to rotate the cover member around the charging member main body, wherein a circumferential speed of one member of the rotating image holder and the rotating charging member main body is greater than a circumferential speed of the other member, and wherein the cover member moves to follow a movement of the one member at a contact portion where the cover member and the image holder come into contact with each other, and a portion of the cover member that is positioned on an upstream side of the contact portion is drawn toward a downstream side of the contact portion so that a shape of the cover member is asymmetric between the upstream side of the contact portion and the downstream side of the contact portion and so that the cover member contacts the charging member main body at location other than the contact portion on an upstream side of the charging member main body.

2. The image forming apparatus according to claim 1, wherein the circumferential speed of the image holder is greater than the circumferential speed of the charging member main body, and wherein the cover member moves to follow a movement of the image holder at the contact portion.

3. The image forming apparatus according to claim 2, wherein a rotational driving force is supplied to the charging member main body from one end side of one end side and the other end side of the charging member main body in the axial direction, and the rotational driving force is not supplied from the other end.

4. The image forming apparatus according to claim 3, wherein by pressing a braking member against the other member, a circumferential speed of the other member is less than the circumferential speed of the one member.

5. The image forming apparatus according to claim 4, wherein the charging member main body is formed of a sponge.

6. The image forming apparatus according to claim 3, wherein the charging member main body is formed of a sponge.

7. The image forming apparatus according to claim 2, wherein by pressing a braking member against the other member, a circumferential speed of the other member is less than the circumferential speed of the one member.

8. The image forming apparatus according to claim 7, wherein the charging member main body is formed of a sponge.

9. The image forming apparatus according to claim 2, wherein the charging member main body is formed of a sponge.

10. The image forming apparatus according to claim 1, wherein a rotational driving force is supplied to the charging member main body from one end side of one end side and the other end side of the charging member main body in the axial direction, and the rotational driving force is not supplied from the other end.

11. The image forming apparatus according to claim 10, wherein by pressing a braking member against the other member, a circumferential speed of the other member is less than the circumferential speed of the one member.

12. The image forming apparatus according to claim 11, wherein the charging member main body is formed of a sponge.

13. The image forming apparatus according to claim 10, wherein the charging member main body is formed of a sponge.

14. The image forming apparatus according to claim 1, wherein by pressing a braking member against the other member, a circumferential speed of the other member is less than the circumferential speed of the one member.

15. The image forming apparatus according to claim 14, wherein the charging member main body is formed of a sponge.

16. The image forming apparatus according to claim 1, wherein the charging member main body is formed of a sponge.

17. The image forming apparatus according to claim 1, wherein the cover member is divided into a first side and a second side by a plane that goes through the contact portion and a center of the charging member main body, and wherein, in response to the portion of the cover member that is positioned on an upstream side of the contact portion being drawn toward a downstream side, the cover member has an asymmetric shape between the first and second sides along the plane.

18. The image forming apparatus according to claim 1, wherein the circumferential speed of one member of the rotating image holder and the rotating charging member main body is between 1% and 20% greater than the circumferential speed of the other member.

19. An image forming unit comprising:

an image holder that is provided to be rotatable and is attachable to and detachable from a main body of an image forming apparatus; and a charging member that includes a charging member main body that has an outer circumferential surface and that is provided to be rotatable and a cover member that covers an outer circumferential surface of the charging member main body which is a separate member from the charging member main body, in which an outer circumferential surface of the cover member is disposed to be in contact with the image holder, and that charges the image holder, wherein the image holder and the charging member main body are the only rotating devices which are used to rotate the cover member around the charging member main body, wherein a circumferential speed of one member of the rotating image holder and the rotating charging member main body is greater than a circumferential speed of the other member, and wherein the cover member moves to follow a movement of the one member at a contact portion where the cover member and the image holder come into contact with each other, and a portion of the cover member that is positioned on an upstream side of the contact portion is drawn toward a downstream side of the contact portion so that the cover member becomes deformed to have an asymmetric shape between the upstream side of the contact portion and the downstream side of the contact portion and so that the cover member contacts the charging member main body at location other than the contact portion on an upstream side of the charging member main body.

* * * * *